US005371952A

United States Patent [19]

Williams

[11] Patent Number: 5,371,952

[45] Date of Patent: Dec. 13, 1994

[54] DRAFTING MACHINE

[76] Inventor: Curtis Williams, 632 S. Quincy, Tulsa, Okla. 74420-4660

[21] Appl. No.: 12,320

[22] Filed: Feb. 2, 1993

[51] Int. Cl.[5] ..... B43L 5/00

[52] U.S. Cl. ..... 33/430; 33/448; 206/224

[58] Field of Search ..... 33/403, 430, 432, 437, 33/448, 1 AA; 312/231; 206/371, 224

[56] References Cited

U.S. PATENT DOCUMENTS 1,314,915 9/1919 Trullench ..... 206/224
3,506,324 4/1970 Fristedt ..... 206/224 X
4,819,338 4/1989 Lategan et al. ..... 33/437

FOREIGN PATENT DOCUMENTS 0277348 11/1949 Switzerland ..... 33/430
0701113 12/1953 United Kingdom ..... 206/224

*Primary Examiner*—William A. Cuchlinski, Jr.
*Assistant Examiner*—Alvin Wirthlin

[57] ABSTRACT

A pan and channelled drawing board combination comprising a transparent drawing surface channelled on two or more sides and pivotally attached at one corner to the upper surface of the lip of the pan and having a surface support attached to the bottom of the pan.

3 Claims, 2 Drawing Sheets

DRAFTING MACHINE

BACKGROUND OF THE INVENTION

1. Field of the Invention

This invention relates to drafting machines.

2. Description of the Prior Art

Drafting machines are combinations of means for embodying a multi-function tool for making mechanical drawings. Such tools often include rulers, a protractor, and a straightedge mountable on a drawing board or table. In the present invention some of these above functions are included, plus a means to store drafting materials within the body of the drawing board itself.

The evolution of the drafting machine has led to a complicated mechanism requiring a large table for support. The present invention is supportable by resting it on one's knees.

This invention does not replace the more complicated drafting machines, which are stationary and not designed to be moved about with the draftsman: this is not its purpose. Nor is it meant to compete with computers in sophistication. The specific prior art problems solved by this invention are those of excessive expense, nonportability, and excessive complexity. Its advantage consists in its simplicity, portability, and economical cost. There are still many people who cannot afford $1000–$2000 dollars for computer assisted drafting or even $300–$500 for conventional state of the art drafting machines which are much too large to be portable. With one straightedge and peripheral slots or channel-guides on only three of the sides, the user can draw any angle through almost any point on the drawing surface.

SUMMARY OF THE INVENTION

An object of this invention is to provide an economical drafting machine.

Another object is to provide a "fast", flexible tool to assist in "sketching ideas" as opposed to highly technical drafting, yet a machine professional enough for layout people and, students and commercial artists and designers.

Another object is a device that can draw any angle through almost any point on the drawingboard surface by simply positioning the pivoting straightedge at appropriate locations in the continuous channel or in one or more of a plurality of separate channels, lifting the straightedge from one to another of the channels, in which case a dowel replaces the fastener of the preferred embodiment.

Still another object is to provide a drafting machine that provides storage for drafting accessories such as templates, pens, ink vials, erasers, paper, and pencil sharpeners.

Another object is a means to lock the pivoting armature in a rest position when it is not in use.

These objects and more are are explained in the detailed description of the preferred embodiment. But in general the objects are obtained by integrating a pivoting straightedge with a drawing board having a channel within the perimeters of its four sides, and the general nature of this device may be stated as a drawing board with a continuous channel inside its perimeters, said channel serving to guide a straightedge thereto attached by a screw which may be tightened for "locking" the straightedge at the desired angle or attitude. U-shaped members may join the two sides of the channel or other means may be used to form an obstruction-clear route between a core and a frame. Spacers between the surface of the drawing board and a base plate may form an obstruction-clear route beneath a continuous channel and also form a separate and distinct storage area for drafting materials. In one embodiment the storage area is equipped with a hinged door which is kept closed by a spring assisted pivoting latch attached to the base plate, which latch may be manually pivoted to prevent the opening of the door and is limited in its revolutions by a plastic nipple which is also used to lift open the unlatched door.

DETAILED DESCRIPTION OF PREFERRED EMBODIMENT

Figure 1:
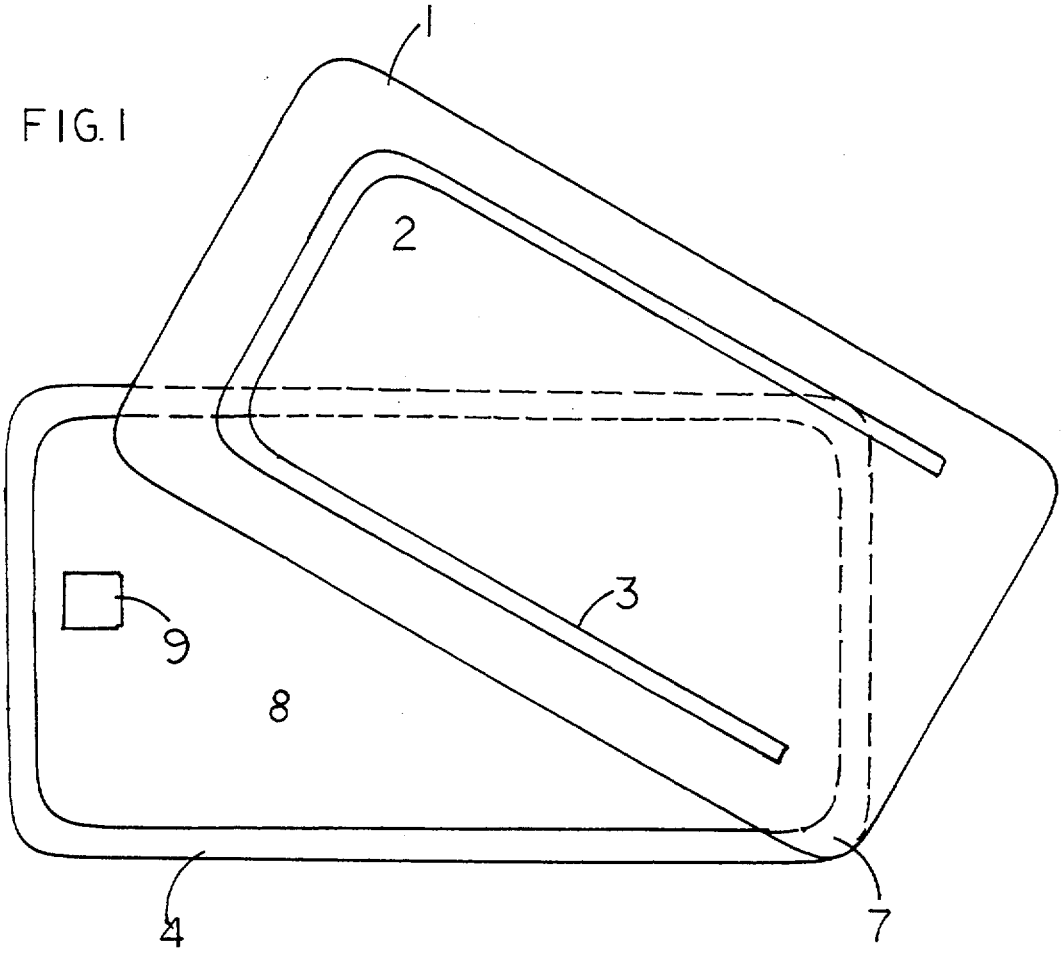
FIG. 1 is a plan view of the drafting machine.
Figure 2:
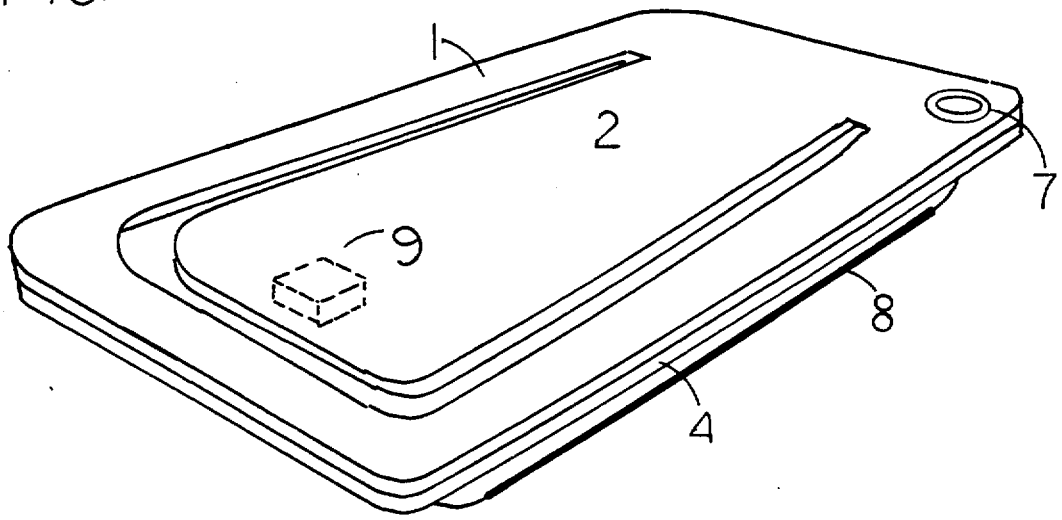
FIG. 2 is a perspective view of the drafting machine.
Figure 3:
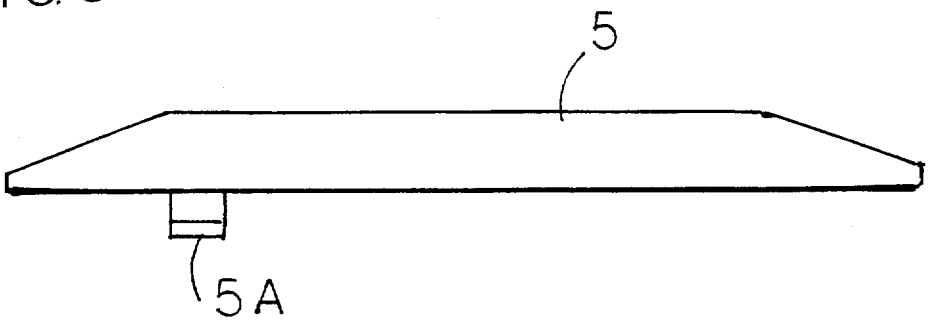
FIG. 3 is a side view of a straightedge.

The preferred embodiment comprises a straightedge 5, a channelled board 1 which may be transparent, and a pan 8. The channelled board 1 is connected to the pan 8 at one corner by a fastener 7, allowing the channelled board to swing away as shown in FIG. 1, permitting objects stored in the pan to be easily retrieved. A version in which the board is hinged to the pan is not new but is included in the concept. The core 2 is separated from the frame 1 by the channel 3, on three sides in this version, requiring a support 9 attached to the bed of the pan 8. Board frame 1 rests on pan lip 4. Straightedge 5 has stud 5A which rides in channel 3. In another version, a fastener pierces one end of the straight edge, with its head anchored in the channel and a tightening means such as a wing nut attached the said fastener above the straightedge.

Construction

I construct my drafting machine by molding a pan and, a channelled board and a straightedge. The several parts are then joined as shown in the drawings.

I claim:

1. A drafting machine comprising:

a drawing board having four edges;

a continuous channel positioned adjacent three of said edges, said continuous channel defining a core in said drawing board;

a pan having four edges corresponding to the edges of said drawing board;

means on said pan for supporting said drawing board;

a straight edge having stud means located thereon for riding in said continuous channel; and support means attached to said pan for supporting said core.

2. The drafting machine of claim 1, wherein said pan is pivotally attached to the drawing board at a corresponding corner of said pan and said drawing board;

3. The drafting machine of claim 1, wherein said drawing board is transparent.

* * * * *